United States Patent [19]

Oba et al.

[11] Patent Number: 4,728,253

[45] Date of Patent: Mar. 1, 1988

[54] APPARATUS FOR ADVANCING AND RETURNING FEED BARS FOR A TRANSFER PRESS

[75] Inventors: Susumu Oba; Kenji Kurishima; Masaharu Kusunoki; Tadao Odaka, all of Sagamihara; Toshihiko Arai, Kanagawa, all of Japan

[73] Assignee: Aida Engineering, Ltd., Sagamihara, Japan

[21] Appl. No.: 888,438

[22] Filed: Jul. 23, 1986

[30] Foreign Application Priority Data

Jul. 31, 1985 [JP] Japan ..... 60-169272
Feb. 25, 1986 [JP] Japan ..... 61-26911[U]

[51] Int. Cl.[4] ..... B30B 15/30

[52] U.S. Cl. ..... 414/749; 72/421; 72/426; 74/99 R; 74/110; 100/215; 100/218; 414/14

[58] Field of Search ..... 414/14–15, 414/18–20, 222, 225–226, 749, 751, 752–753, 745; 100/215, 218; 74/52, 99 R, 110; 72/346, 421, 422, 426

[56] References Cited

U.S. PATENT DOCUMENTS

| | | | |
|---|---|---|---|
| 2,693,159 | 11/1954 | Taylor | 100/218 X |
| 2,811,266 | 10/1957 | Udal | 100/218 X |
| 3,080,983 | 3/1963 | Blatt | 72/426 X |
| 3,988,937 | 11/1976 | Higuch | 414/749 X |
| 4,012,937 | 3/1977 | Imanishi | 72/421 X |
| 4,192,169 | 3/1980 | Münch et al. | 72/421 X |
| 4,292,892 | 10/1987 | Combs | 100/218 |
| 4,361,413 | 11/1982 | Toda | 414/225 X |
| 4,393,682 | 7/1983 | Imanishi | 72/421 X |
| 4,404,837 | 9/1983 | Allen et al. | 72/421 X |
| 4,462,741 | 7/1984 | Sogawa et al. | 100/215 X |
| 4,589,819 | 5/1986 | Shirao | 414/225 X |
| 4,637,243 | 1/1987 | Bond | 74/110 X |

FOREIGN PATENT DOCUMENTS

| | | | |
|---|---|---|---|
| 2757625 | 6/1979 | Fed. Rep. of Germany | 100/215 |
| 55-22170 | 6/1980 | Japan . | |
| 2143490 | 2/1985 | United Kingdom | 100/215 |

*Primary Examiner*—Robert J. Spar
*Assistant Examiner*—P. McCoy Smith
*Attorney, Agent, or Firm*—Wenderoth, Lind & Ponack

[57] ABSTRACT

Feed bar advance and return driving apparatus for a transfer press. An upper slider is reciprocally vertically movable in the press crown in synchronization with the operation of the press, and a pinion rotatably mounted on the upper slider is rotated alternatingly in opposite directions with the upward and downward vertical movement of the upper slider. A drive rack vertically slidably supported on the upper slider is connected to the pinion at a position on the pinion which is eccentric to the axis of rotation of the pinion and is reciprocally vertically driven by the rotation of the pinion. The lower end of the drive rack extends downwardly and engages a drive pinion for rotating the drive pinion alternatingly in opposite directions during the reciprocal vertical motion of the drive rack. A drive lever connected to the drive pinion at a position eccentric to the axis of rotation of the drive pinion and pivotally mounted on the press is driven in a swinging motion and is connected to a lower slider for supporting feed bars of the press to drive the lower slider in advancing and returning directions.

12 Claims, 9 Drawing Figures

APPARATUS FOR ADVANCING AND RETURNING FEED BARS FOR A TRANSFER PRESS

DETAILED DESCRIPTION OF THE INVENTION

1. Field of Industrial Application

The present invention relates to a feed bar driving apparatus for a transfer prss, and more particularly to an apparatus for advancing and returning the feed bars.

2. Prior Art

Heretofore, various kinds of devices have been developed for a transfer device for transferring workpieces to plural dies provided in a transfer press.

In the prior transfer device, a pair of feed bars are disposed along and on both sides of the dies and are provided with advancing and returning movements so that they repeat advance, stop, return and stop motions in the longitudinal direction of the feed bar as well as unclamping and clamping movements so that they move away from and toward each other during the two stop periods, said pair of feed bars transferring the workpieces by holding them therebetween with fingers numerically corresponding with the dies. The feed bars can also be given clamping/lifting and lowering/unclamping movements during the two stop periods in the advancing and returning movements, as the occasion demands.

One example of a prior transfer device is described in Japanese Patent Publication No. 55-22170. This device is a transfer press characterized in that it has, in a planet gear mechanism having a sun gear and a planet gear in the gear ratio of 2 to 1, an arm which is kept rotatably and coaxially with the sun gear, a first eccentric pin which is provided on the planet gear, a groove which is formed radially in the arm and in which is engaged the first eccentric pin and a second eccentric pin which is provided on the arm engaged in a groove in a slider.

The timing of the transfer drive relative to the crank angle in a transfer press is that: the feed bars advance workpieces and stop in the course of 120° extending from crank angle 300° and past top dead center 0° and to crank angle 60°, and then the workpieces remain at rest and are unclamped by the feed bars int eh course of subsequent crank movement through 60°, and the feed bars return and stop in the course of subsequent crank movement through 120° with the pressing operation having being performed, and then the feed bars clamp the workpieces in the course of the last 60°.

In the above-described prior art, the standard stop angle between ends of advance and return is 60°. Actually, the stop angle is available up to 70°, but in which case the feed bars make an imperfect stop and they displace or reciprocate a little in the advancing and returning directions during the stop periods. This displacement tends to be noticeable the larger the stop angle becomes. Further, the prior art has a problem that there exist large gears below the ends of the feed bars, thereby restricting the space for providing chutes for taking workpieces into and out of the press.

In addition, the prior art has a problem that the mechanism for adjusting the length of the advance and return stroke is complicated.

OBJECTS OF THE INVENTION

It is an object of the present invention to solve the problems of the prior art and to provide a driving apparatus which can provide a free selection in changing the feed bar stop angle although the standard angle is 70°, and which can make a perfect stop.

Another object of the present invention is to provide a driving apparatus which can adjust the length of the feed bar stroke in the advancing and returning directions.

According to the present invention, vertically extending guide racks are provided in a press crown and a slider is mounted on the guide racks in a vertically movable manner, while an eccentric shaft of a main gear provided on a press crankshaft is engaged with a longitudinal groove formed in the slider in the forward/rearward direction of the press, thereby lifting and lowering the slider. The slider is also provided with a pinion meshing with the guide rack, and the pinion is provided with an eccentric pin. On the other hand, a drive rack is provided in the press in a vertically movable manner and in parallel to the guide rack, and the drive rack and the slider are slidably supported on each other. The eccentric pin of the pinion is engaged with a lateral groove formed in the upper part of the drive rack in the forward/rearward direction of the press.

A drive pinion meshing with the drive rack is provided in a drive unit casing disposed in a press column or bed, and an eccentric pin of this drive pinion is connected to a lever provided in the casing in a swinging manner by a fulcrum pin. Further, the lever is movable in the transfer direction of workpieces and is connected to a slide plate for supporting the feed bar.

As the slider moves up and down,being driven by the press operation and supported by the guide racks, the drive rack moves up and down and causes the eccentric pin of the drive pinion to turn about a supporting axis. The lever connected to the eccentric pin reciprocates at its lower end in the transfer direction. Thus, the reciprocation of the end of the lever is used to drive the feed bar in advancing and returning directions.

The eccentric pin of the pinion provided on the slider is located 180° opposite to the guide rack when the slider is in themiddle of its upper and lower limits. The eccentric pin is arranged to turn $180°+\theta$ each time the slider moves from the middle position to the upper and lower limits. By this arrangement, the eccentric pin generates a locus such that the eccentric pin stops while the slider travels from a point a little before the upper and lower limits to said limit, or in other words, while the pinion rotates $2\theta$, wherby the drive rack repeats the upward, stop, downward and stop motions.

By changing the eccentricity of the eccentric axis of the main gear the stop angle of the eccentric pin can be changed.

By changing the mounting position of the fulcrum pin of the lever, the length of the advance and return stroke of the feed bar can be changed. Further, the stops between the ends of advance and return can be made accurate and the stop angle can be freely changed.

DESCRIPTION OF THE DRAWINGS

FIG. 2 is a side elevational view, partly in section, of a press crown;

FIG. 3 is a sectional view taken on line III—III of FIG. 2;

FIG. 4 is a front view of parts incorporated in a press column;

FIG. 5 is a sectional view taken on line V—V of FIG. 4;

FIG. 8 is a front view and FIG. 9 is a sectional view taken on line IX—IX of FIG. 8.

EMBODIMENTS

Figure 1:
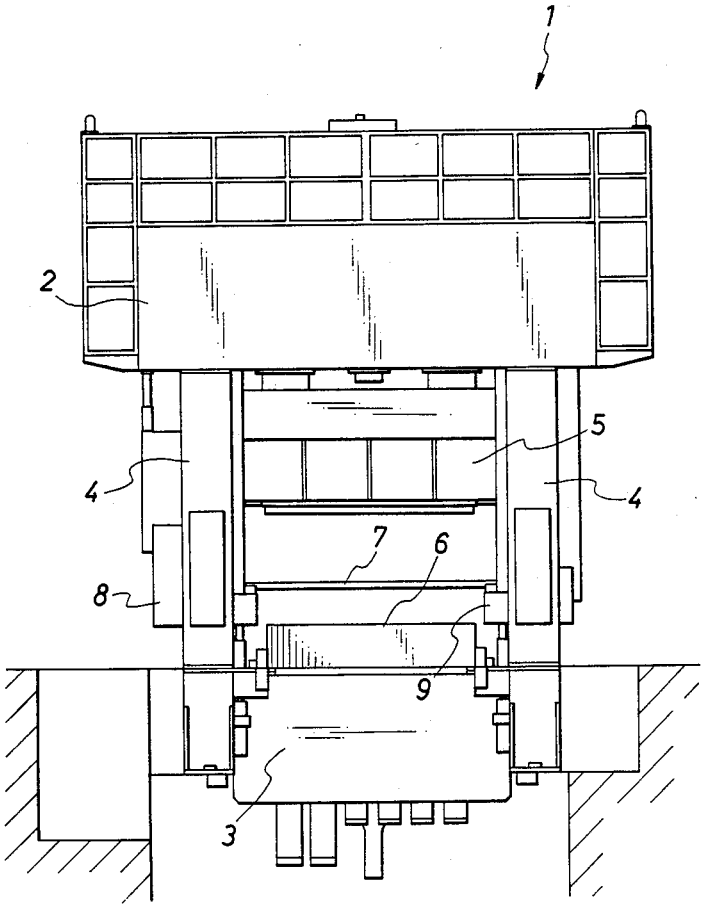
FIG. 1 is a schematic view of a press.

FIG. 1 is a schematic view of a press 1 having a crown 2 and a bed 3 joined together by columns 4 inside which a press slide 5 is provided and is lifted and lowered relative to a bolster 6 provided on the bed 3.

A pair of feed bars 7 are provided on both sides of plural dies, not shown, placed on each bolster 6, and the feed bar is connected at one end to a drive unit casing 8 from which it receives advancing and returning movements and at the other end to a drive unit casing 9 from which it receives clamping/unclamping and lifting/-lowering movements.

FIGS. 2 to 5 show a mechanism by which a feed bar is given advancing and returning movments.

Figure 2:
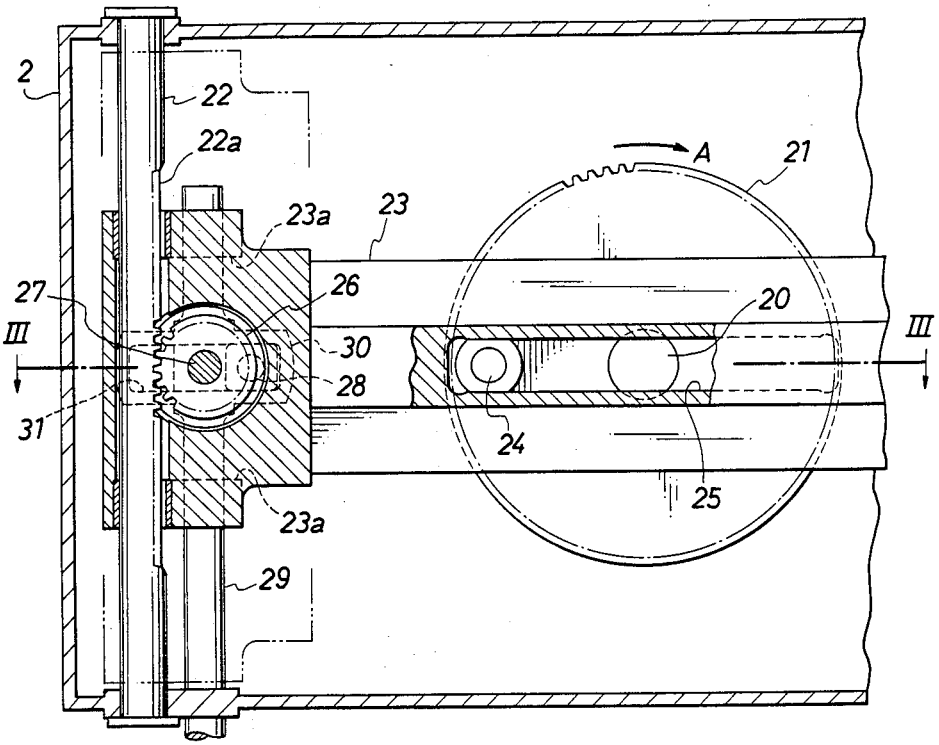
FIG. 2 to 5 show a mechanism for advancing and returning feed bars.
Figure 3:
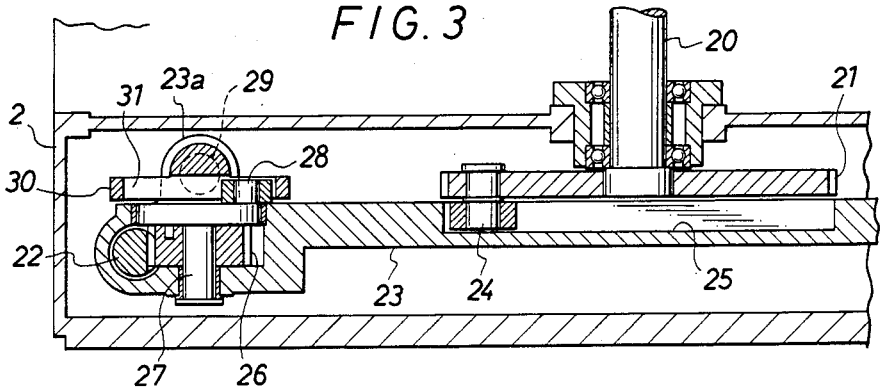

In FIGS. 2 and 3, a press crankshaft 20 has a main gear 21 fixed on the end thereof, and guide racks 22 (the guide rack on the opposite side being omitted herein) are vertically provided at the ends of the crown 2 in the forward/rearward direction of the press so that they are disposed with the main gear 21 therebetween and symmetrically with respect to a vertical line passing through the center of the crankshaft, and an upper slider 23 is slidably provided on the guide rack 22.

The guide rack 22 is in the form of a column and is provided with teeth 22*a* toward the center of the press. On the surface of the main gear 21 opposite to the upper slider 23 is an eccentric shaft 24, and a longitudinal groove 25 is formed int he upper slider 23 in the forward/ rearward direction of the press so as to be slidably engaged by the eccentric shaft 24. As the main gear 21 rotates in the direction A as indicated by the arrow in FIG. 2, the upper slider 23 moves up and down from the position shown in the drawing to positions indicated by a dot-and-dash line.

A pinion 26 is rotatably provided on the upper slider 23 on a supporting shaft 27 and meshes with the teeth 22*a* of the guide rack 22. On the side of the pinion 26 is an eccentric pin 28 which has a required eccentricity and is eccentric for a half of the pitch circle of the pinion 26 in this embodiment. The upper slider 23 is proviced with a drive rack 29 which is parallel to the guide rack 22 and extends downwardly through the bottom wall of the crown 2, and the upper part of the drive rack 29 is slidably supported by bosses 23*a* which are provided on the slider 23. The drive rack 29 between the bosses 23*a* has a larger diameter in mid portion, where a cross member 30 is integrally provided and is provided with a lateral groove 31 for slidable engagement by the eccentric pin 28 of the pinion 26.

The pinion 26 meshes with the teeth 22*a* of the guide rack 22 and is arranged to rotate $180°+\theta$ while the upper slider 23 travels from the vertically middle position to the upper and lower limits. The eccentricity of the eccentric shaft 24 of the main gear 21 is adjustable, and $\theta$ becomes large with an increase in the eccentricity, in which case the stroke of the upper slider incrases, and on the other hand $\theta$ becomes small with a decrease in the eccentricity.

Figure 6:
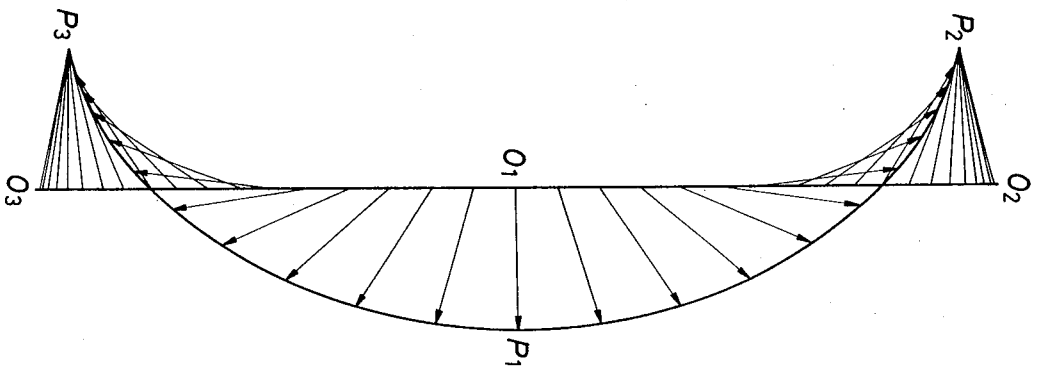
FIG. 6 is a locus graph showing the center of a pinion for moving a drive rack up and down and the center of an eccentric pin thereof.

In FIG. 6, the center 01 of the pinion 26 moves up and down between the upper limit 02 with a slider 23 at its top and the lower limit 03 with the slider 23 at its bottom. The displacement of 01 is the product of the eccentricity e of the eccentric shaft 24 of the main gear 21 and the sine of the rotational angle of the crankshaft 20 (referred to as the crank angle of the press). P1 is the center of the eccentric pin 28, and with the vertical displacement and the following rotation of the pinion 26, the direction of 01P1 gradually changes. As shown, upper and lower limits P2 and P3 which are the locus of P1 make substantially no vertical displacement (a little motion is seen but the quantity thereof is very small) in the course of angle $\theta$ before and after the pinion 26 rotates 180°, namely in the course of $2\theta$ in total. This angle $2\theta$ is adjustable as described above, and it is easy to set a 70° angle as the standard.

Figure 4:
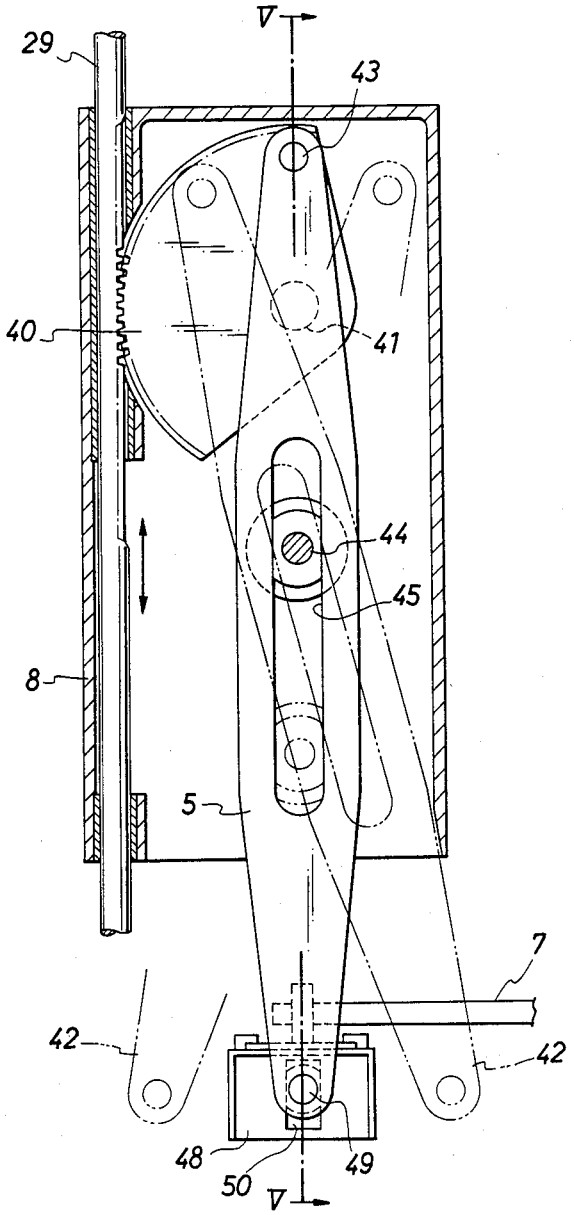
Figure 5:
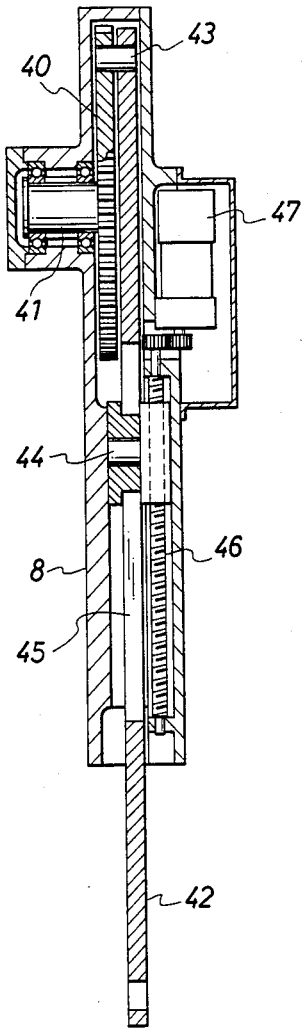

In FIGS. 4 and 5, the lower part of the drive rack 29 is guided in a vertically movable manner in the drive unit casing 8 which is provided inside each column at the front and rear of the press.

Inside the drive unit casing 8 is a sector gear or drive pinion 40 rotatably provided on a supporting shaft 41 and meshing with the drive rack 29, and a drive lever 42 is connected to a peripheral part of the sector gear 40 by a pin 43. The drive lever 42 protrudes from under the casing 8 and is slidably supported on a fulcrum shaft 44 inside the casing 8. The fulcrum shaft 44 is slidable in a longitudinal opening 45 of the drive lever 42 and is threadedly mounted an adjusting screw 46 at the rear of the drive lever 42. The adjusting screw 46 is rotatably driven by a stepping motor 47 with an encoder provided in the casing 8.

Further, the lower end of the drive lever 42 is connected to a horizontally reciprocating slider 48. A pin 49 which connects the slider 48 to the drive lever 42 is slidably provided in a longitudinal opening 50 of the slider 48 and regulates the swinging motion of the drive lever 42 in the longitudinal direction. The slider 48 is provided with the pair of feed bars 7.

The swinging motion of the drive lever 42 reciprocates the slider 48, thereby causing the feed bars 7 to perform the longitudinal movements, namely advancing and returning movements.

By changing the position of the fulcrum axis 44, the length of the feed bar stroke can be changed. By turning the adjusting screw 46 by the drive from the stepping motor 47, the fulcrum shaft 44 can vertically change its position in the longitudinal opening 45 of the drive lever 42. In the condition as shown, the feed bar has the longest feed stroke. If the fulcrum shaft 44 is moved lower than this position, the feed stroke becomes shorter.

Figure 7:
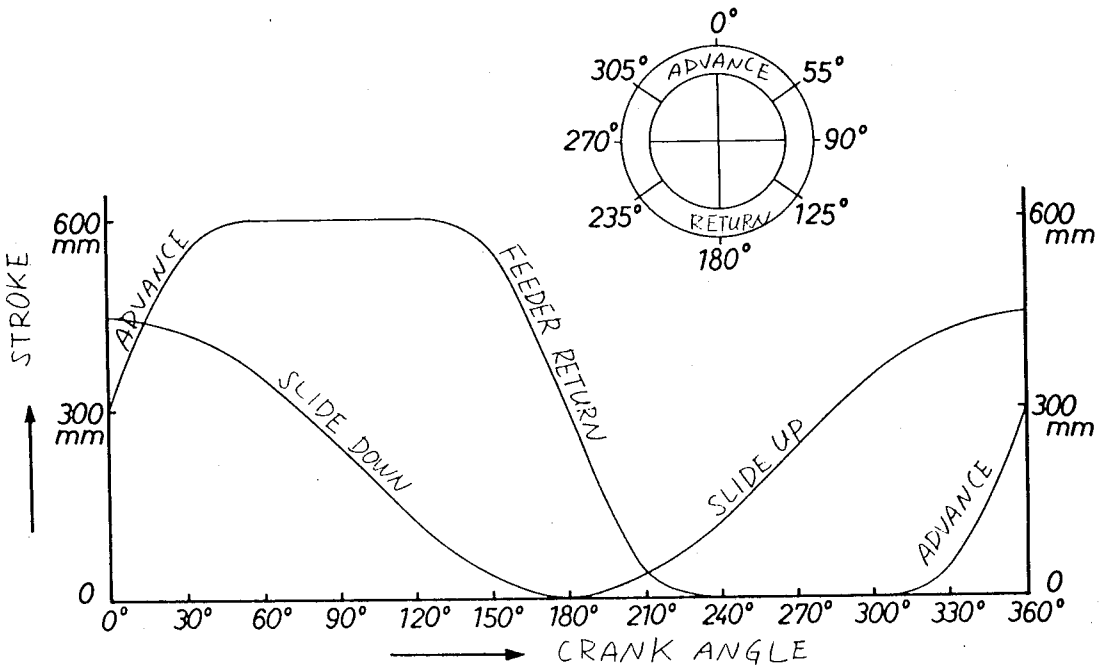
FIG. 7 is a graph of the stroke and crank angle showing the sliding movement of the press and the advancing and returning movements of the feed bars.

FIG. 7 shows the advancing and returning movements of the feed bar 7 and the lifting and lowering movements of the press slide, in comparison to the crank angle of the press. The feed bar 7 advances with the press at a crank angle of 305° to 55°, returns with the press at a crank angle of 125° to 235°, and stops while the crank is moving through 70° (stop angle) from a crank angle of 55° to an angle of 125° and 235° to 305°. The stop angle of 70° is standard and is easily changeable by changing the eccentricity of the eccentric shaft 24 of the main gear 21, and with this stop angle, the feed bar stops stably.

Figure 9:
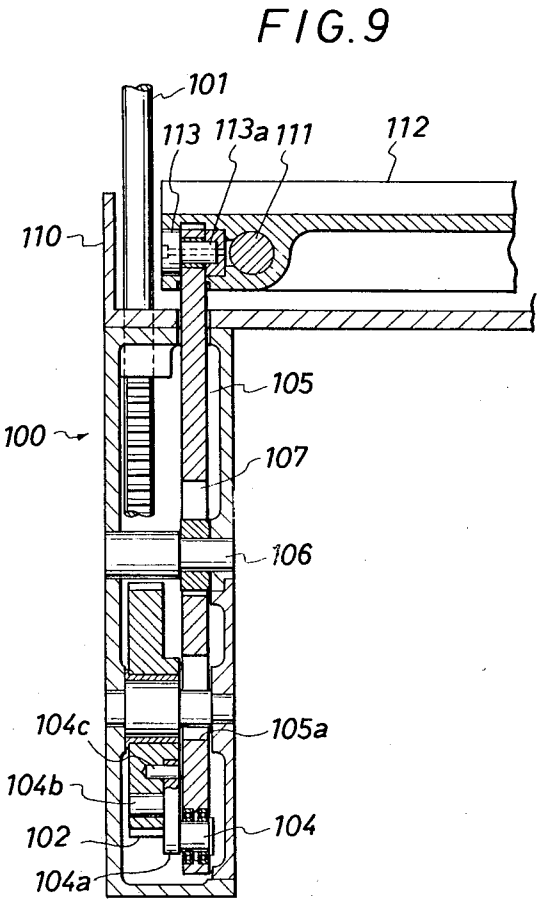
FIGS. 8 and 9 show a second mechanism for advancing and returning the feed bars.
Figure 8:
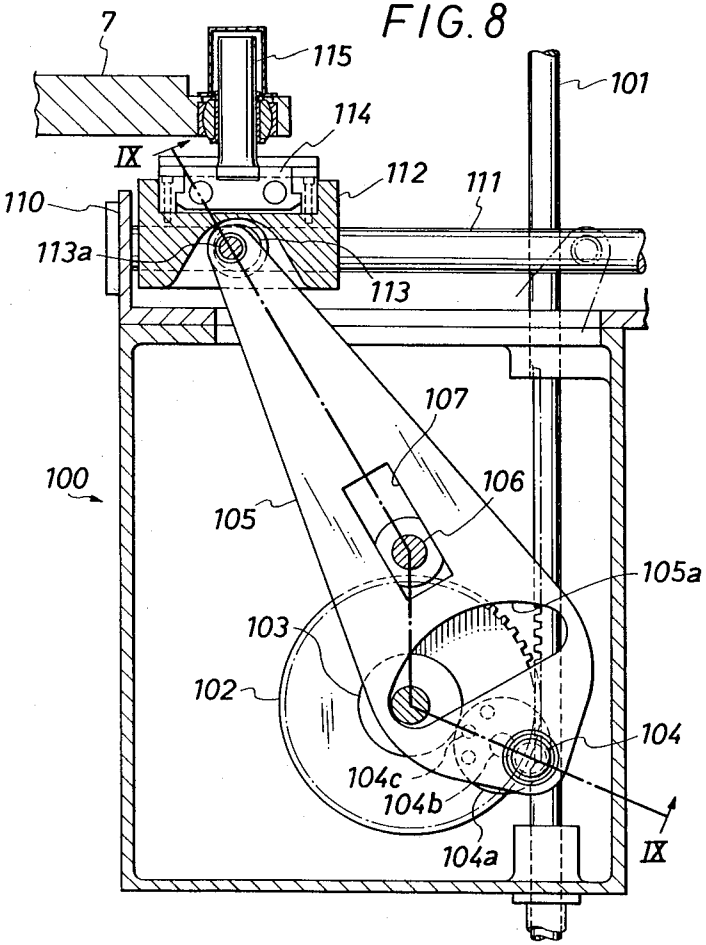

FIGS. 8 and 9 shows a second embodiment of the apparatus for advancing and returning the feed bars.

In a drive unit casing 100, a drive rack 101 meshes with a drive pinion 102 and the drive pinion 102 is rotatably mounted on a supporting shaft 103, and a connectin pin 104 is provided on an eccentric part of the drive pinion 102 and is connected to a lower end of a drive lever 105. A fulcrum shaft 106 is provided in the casing 100 above the drive pinion 102 and is slidably engaged in a longitudinal opening 107 formed in the drive lever 105. With the up-and-down movements of the drive rack 101, the drive pinion 102 causes the connecting pin 104 to turn equiangularly about the center of the shaft of the drive pinion 102, whereby the drive lever 105 swings from side to side in FIG. 8 around the fulcrum shaft 106 while said lever is sliding by means of the longitudinal opening 107, and the upper end of the drive lever 106 moves from side to side almost in the horizontal direction around the fulcrum shaft 106. This is possible by proper selection of the ratio of the eccentricity of the connecting pin 104 on the drive pinion 102 to the length of the drive lever 105.

In a casing 110 fixed ont he upper surface of the unit casing 100, two guide rods 111 are provided in the side-to-side direction in FIG. 8, namely in the longitudinal and advancing/returning direction of the feed bar 7, and a lower slider 112 is provided in the unit casing 100 and reciprocates while being guided by the guide rods 111. A pivot 113 is rotatably mounted at the position on the lower slider 112 corresponding to the drive lever 105 and is connected by an eccentric part **113*a* thereof to the upper end of the drive lever 105. Consequently, a little vertical movement occurring when the upper end of the drive lever 105 swings with the horizontal motion, is absorbed by a little rotation of the pivot 113, whereby the lower slider 112** makes an extremely smooth movement.

Slidable receptacles 114 are provided on the lower slider 112 in the horizontal direction perpendicular to the guide rods 111. Each of the receptacles 114 has a pin 115 thereon and the pair of feed bars 7 are removably connected to the pins 115, respectively.

The drive lever 105 is provided with an opening **105*a* therein for keeping its swinging motion free from interference with the shaft of the drive pinion 102. In addition, the connecting pin 104 is provided on a disc 104*a* which is attached rotatably to the drive pinion 104. The disc 104*a* is mounted on the drive pinion 102 by a mounting shaft 104*b* and a location pin 104*c* may be pulled out to allow the disc 104*a* to be rotated a little and then the pin can be replaced, whereby a little adjustment of the eccentricity of the connecting pin 104 can be carried out to incline the equiangular swinging motion of the drive lever 105** to the right or left a little, thereby effecting displacement to right or left of the area of the feed bar stroke.

Further, the length of the feed bar stroke can be adjusted by changing the mounting position of the fulcrum shaft 106 which supports the drive lever 105.

What is claimed is:

1. Feed bar advance and return driving apparatus having a press crown, said apparatus comprising:

an upper slider reciprocally vertivcally movable in said press crown in synchronization with the operation of the press;

a pinion rotatably mounted on said upper slider so as to rotate alternatingly in opposite directions with the upward and downward vertical movement of said upper slider;

a drive rack vertically slidably supported on said upper slider and connected to said pinion at a position on said pinion which is eccectric to the axis of rotation of said pinion and for being reciprocally vertically driven by the rotation of said pinion, said drive rack having a lower end extending downwardly;

a drive pinion rotatably mounted on said press and engaged by said lower end of said drive rack for being rotated by said drive rack alternatingly in opposite directions during the reciprocal vertical motion of said drive rack;

a drive lever means connected to said drive pinion at a position eccentric to the axis of rotation of said drive pinion and pivotally mounted on said press; and a lower slider for supporting feed bars of said press and connected to said drive lever means and driven in advancing and returning directions by the swinging motion of said drive lever means during rotation of said drive pinion.

2. A driving apparatus as claimed in claim 1 further comprising guide racks at the front and rear ends of said press crown, said upper slider being vertically slidably mounted on said guide racks, said slider having a longitudinal groove therein, and said press having a press crankshaft with a main gear thereon and the main gear having an eccentrically mounted shaft engaged in said longitudinal groove for moving said upper slider up and down.

3. A driving apparatus as claimed in claim 2 wherein said pinion has teeth meshing with the teeth on one of said guide racks.

4. A driving apparatus as claimed in claim 1 in which said drive rack has a laterally extending groove in a part thereof facing said upper slider, and said pinion having an eccentrically mounted pin thereon engaged in said laterally extending groove.

5. A driving apparatus as claimed in claim 4 in which said part of said drive rack facing said uppre slider is a cross member.

6. A driving apparatus as claimed in claim 1 in which said drive lever means has a longitudinal groove extending therealong, and said press has a fulcrum shaft thereon slidably engaged in said longitudinal groove, said drive pinion having an eccentrically mounted pin thereon, said drive lever having a upper end connected to said eccentrically mounted pin on said drive pinion and having the lower end connected to the lower slider.

7. A driving apparatus as claimed in claim 6 in which said fulcrum shaft is adjustably mounted for changing the fulcrum axis of said drive lever means.

8. A driving apparatus as claimed in claim 7 in which an adjusting screw is mounted on said press extending parallel to the length of said drive lever means and said fulcrum shaft is mounted for movement along said adjusting screw when said adjusting screw is rotated about its longitudinal axis, and a motor connected to said adjusting screw for rotating said adjusting screw.

9. A driving apparatus as claimed in claim 8 in which said motor is a stepping motor having an encoder.

10. A driving apparatus as claimed in claim 1 in which said drive pinion is a sector gear.

11. A driving apparatus as claimed in claim 10 further comprising a unit casing in which said sector gear is mounted, and said sector gear has an eccentrically mounted pin adjustably mounted thereon to which said drive lever means is connected.

12. A driving apparatus as claimed in claim 11 in which said sector gear has a disc rotatably mounted thereon on which said eccentrically mounted pin is mounted, and a location pin removably insertable in said disc for engaging said sector gear for holding said disc in position when said location pin is inserted in said disc.

* * * * *